US005454626A

United States Patent [19]

Schiffer et al.

[11] Patent Number: 5,454,626

[45] Date of Patent: Oct. 3, 1995

[54] METHOD OF CONFIGURING BRISTLE BUNDLES

[75] Inventors: Carl Schiffer; Berthold Meyer, both of Neustadt, Germany

[73] Assignee: M + C Schiffer GmbH, Neustadt, Germany

[21] Appl. No.: 248,924

[22] Filed: May 25, 1994

[30] Foreign Application Priority Data

May 26, 1993 [DE] Germany ..... 43 17 453.1

[51] Int. Cl.[6] ..... A46D 1/04; A46D 1/06

[52] U.S. Cl. ..... 300/21; 300/2

[58] Field of Search ..... 300/4, 5, 7, 8, 300/10, 11, 21

[56] References Cited

U.S. PATENT DOCUMENTS 2,488,873 11/1949 Maynard ..... 300/21

4,609,228 9/1986 Bichel ..... 300/21 X 5,033,797 7/1991 Rueb ..... 300/21 X

FOREIGN PATENT DOCUMENTS 1133844 11/1956 France ..... 300/21

1460850 10/1966 France ..... 300/21

*Primary Examiner*—Timothy V. Eley

*Attorney, Agent, or Firm*—Anderson Kill Olick & Oshinsky

[57] ABSTRACT

A method for configuring the use ends of the bristles of at least one bristle bundle in the fabrication of bristle products, including cutting the bristle bundle to a predetermined dimension and inserting it into the channel in a carrier, and bringing the use ends into a contact with a surface of a configuration plate having a configuration corresponding to the configuration of the use ends of the bristles of the bristle bundle, under gas pressure acting on bristle ends which are opposite to use ends.

7 Claims, 1 Drawing Sheet

METHOD OF CONFIGURING BRISTLE BUNDLES

BACKGROUND OF THE INVENTION

The invention relates to a method of and apparatus for configuring use ends of bristles of at least one bristle bundle during fabrication of bristle products, particularly of tooth brushes, according to which the use ends of the bristle bundle, which is inserted into a channel of a carrier and cut to a predetermined dimension, contacts the surface of a configuration plate, with the surface of the configuration plate having a shape corresponding to the configuration of the use bristle ends of the bristle bundle.

With products used in body care, for instance toothbrushes, it is required that the free end of a bristle bundle or the use ends of the bristles of a bristle bundle have a precisely prescribed configuration.

A method of configuring the use ends of the bristles of bristle bundles is already known from the U.S. Pat. No. 2,488,873, where each individual bristle bundle is inserted into an appropriately disposed channel of a carrier, where it can also be clamped in a tight manner. After the clamping is disengaged, a configuration plate is placed upon the carrier which supports the bristle bundle, with the surface of the configuration plate corresponding to the configuration of the bristle bundle, or which has a blind hole for the bristle bundle, with the base surface of the hole having a depth and shape which coincides with the desired configuration of the use ends of the bristles of the bristle bundle. There is also provided a carrier plate to which at least one piston is attached, with the length and the shape of the free end face of the piston being precisely matched to the surface or the base surface of the blind hole in the configuration plate. For configuring the use ends of the bristle of the bristle bundle inserted into the carrier, the carrier plate together with its piston is now moved toward the carrier, so that the piston can penetrate into the channels in the carrier and can displace the bristle bundle or the individual bristles contained therein so far or to such an extent until they rest at the surface of the configuration plate or at the base surface of the blind hole. This enables to achieve a predetermined configuration of the bristle bundle or the use ends of the bristles of that bristle bundle.

This previously known method requires that the length of the piston as well as the arrangement and the shape of the end face of the piston be matched very precisely to the depth and the shape of the surface of the configuration plate or to the base surface of the blind hole, since otherwise undesirable deformations of the bristles can occur. This sets rather high requirements for the apparatus. It has to be assured additionally, that the piston assumes a position which is in true alignment with the channel in the carrier. Another configuration plate and a carrier with the appropriate piston matched accurately thereto is always required for any change in the configuration of the use ends of the bristles of a bristle bundle.

The object of the invention is a method of and apparatus for configuring the use ends of the bristles of at least one bristle bundle during fabrication of bristle products, especially of toothbrushes, that the bristle bundle or the use ends of the bristles of the bundles can be configured without using a carrier plate or piston for displacing the bristle bundle or the bristles in the channel of the carrier.

SUMMARY OF THE INVENTION

The object of the invention is achieved by bringing the bristle bundle to rest with the use ends of the bristles at the surface of the configuration plates by a compressed gas and/or a vacuum.

Such a method can eliminate the previously required carrier plate with its piston. This reduces the fabrication costs and the wear of the corresponding device. When the configuration of the use ends of the bristles of the bristle bundle is changed, only the configuration plate must be replaced. The method of the invention also assures that no pressure which can deform individual bristles is exerted upon the bristle bundle. The wear of the device, which results from wear of the carrier plate, together with the piston, is eliminated.

BRIEF DESCRIPTION OF THE DRAWINGS

The effects and features of the present invention will become more apparent, and the invention itself will be better understood from the following detailed description of the preferred embodiments when read with reference to the accompanying drawings, wherein.

DETAILED DESCRIPTION OF THE PREFERRED EMBODIMENT

Figure 1:
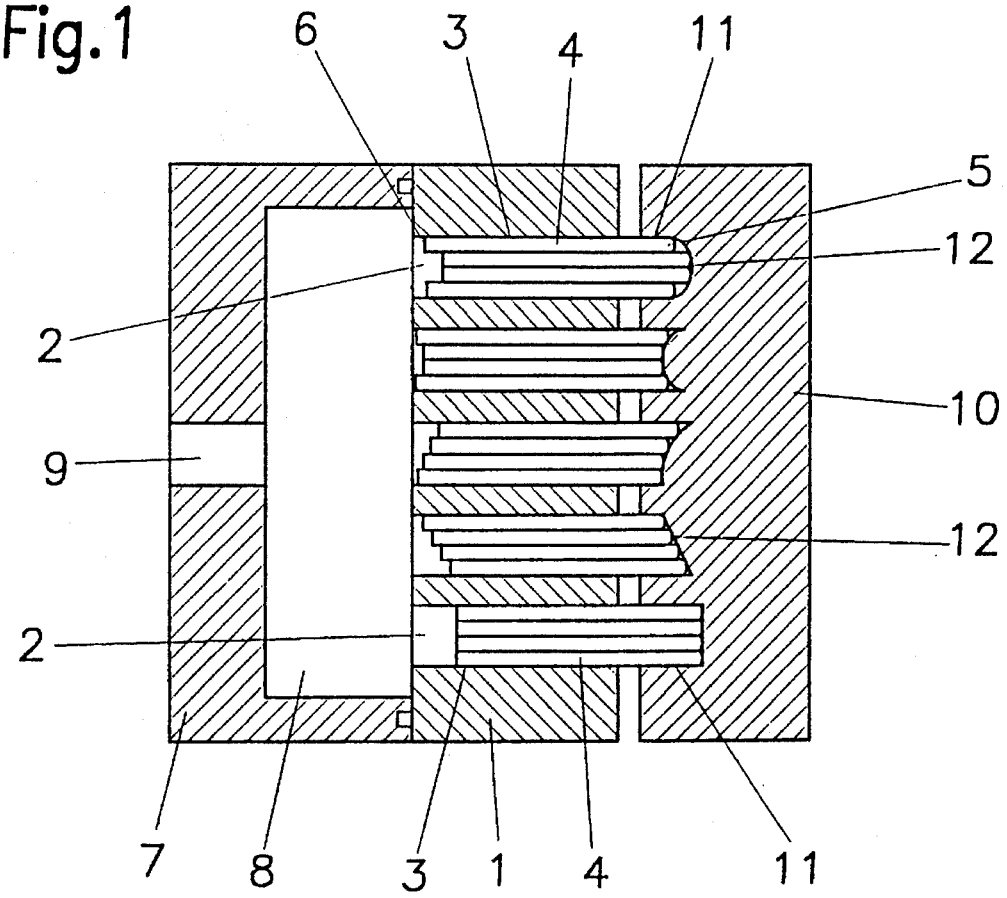
FIG. 1 is a cross-sectional view of a device for performing the method of the present invention.

A plate-like carrier 1, shown in FIG. 1, forms a part of a device for configuring the use ends of the bristles 5 of bristle bundles 3. The carrier is shown as one single piece. If need be this carrier 1 can also consist of two plates aligned to be flush with each other. A plurality of channels 2 are formed in the carrier 1. The quantity and disposition of the channel are identical with the design of the brush head of a toothbrush.

In FIG. 1, the carrier 1 has only four spaced-from-each-other channels 2 for simplification of the illustration. A bristle bundle 3, which consists of a plurality of bristles 4, is located in each channel 2. The quantity of the bristles 4 in a bristle bundle 3 corresponds to the cross-section of the channels 2. For clarity's sake, only four greatly magnified bristles 4 of a bristle bundle 3 located in the channel 2 are shown. The length of the bristles 4 or the bristle bundles 3 can correspond precisely to the thickness of the carrier 1 and thus to the length of the channels 2. In the embodiment shown, the bristles 4, all of equal length, are however configured to be longer than the channels 2. Herein, all bristles 4 assume such a position that all end faces or ends of the bristles 4 are in one single plane. The use ends 5 of all bristles 4 are rounded, while the other ends 6 have a planar face extending perpendicularly to the bristle axis. A housing 7, which has a chamber 8, is brought into a pressure-tight contact with the side face of the carrier 1, facing the planar ends 6. An aperture 9 opens into this chamber 8, with a compressed air line, not shown, being connected to the aperture 9.

A configuration plate 10 is now provided on the other side of the carrier 1, which plate can be moved against the carrier 1 and is equipped with a plurality of blind holes 11 corresponding in number to the number and the disposition of the channels 2 or the bristle bundle 3. In the embodiment shown, each blind hole 11 has a different depth. In addition, the base surface 12 of each blind hole 11 is shaped in a different way. Herein, the base surface 12 can be concave, convex, arcuate as well as be configured as a straight or inclined plane. The depth of the blind holes 11 and the shape of the base surface 12 correspond precisely to the desired configuration of the individual bristle bundles 3. As soon as the configuration plate 10 has arrived at the predetermine position, compressed air at a pressure of approximately 2 to 6 bar, preferably 5 bar, is applied to the chamber 8. Because of this compressed air, the individual bristles 4 of the bristle bundle 3 are displaced in axial direction into the blind holes 11 and thus against the base surfaces 12 of the blind holes 11. The bristle use ends 5 of the bristles 4 of each bristle bundle 3 now have a configuration which corresponds precisely to the base surface 12 of the blind holes. As soon as it is assured, that all bristles 4 rest against the base surface 12 of the blind holes, the air pressure is reduced and the housing 7 is again removed from the carrier 1.

Now the bristle bundles 4 are processed further in a known usual manner. The bristles 4 of each bristle 3 are melted or fused so as to form a thickening at their connection side ends, which thickenings serve in an ensuing work step for fastening the bristle bundles in a bristle carrier.

Figure 2:
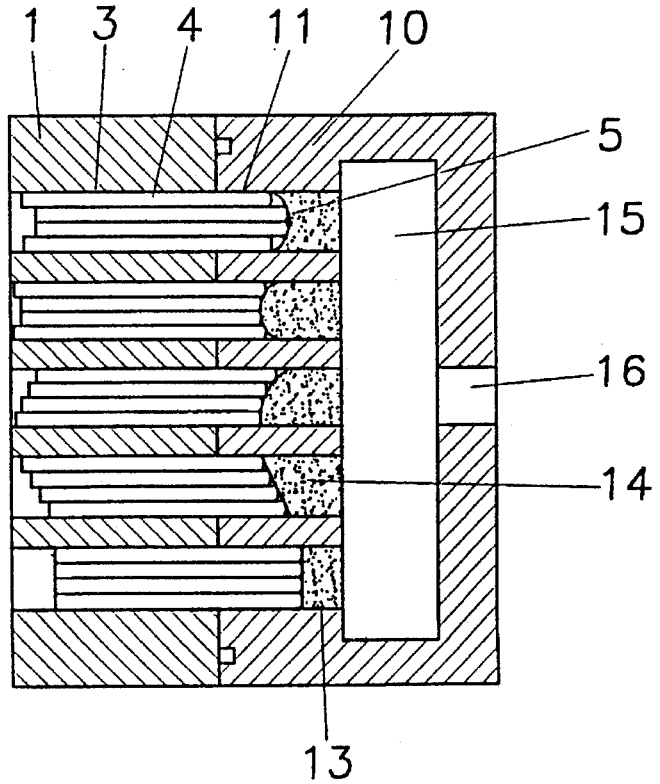
FIG. 2 is a cross-sectional view of another embodiment of the device for performing the method of the present invention.

The embodiment of the device shown in FIG. 2, coincides largely with the embodiment of FIG. 1. However in this case, instead of the blind holes in the configuration plate 10, there are provided through bores 13 into which plugs 14 can then be inserted so that the blind holes 11 are again formed. Herein, the plugs 14 have end faces at their inner ends, which correspond precisely to the base surfaces 12 of the blind holes 11 in FIG. 1. The plugs 14 are fabricated from a sintered metal and are porous throughout. The configuration plate 10 is provided with a chamber 15 having an aperture 16. A vacuum can be applied to the chamber 15 through this aperture 16. If in this embodiment, the configuration plate 10 rests at the carrier 1 and a vacuum has been built up in the chamber 15, the bristles 4 are pulled against the base surfaces 12 of the blind holes 11, so that a configuration of the use ends of the bristles 5 of the bristle bundles 3 can also be obtained by using vacuum. Of course, in the embodiment of FIG. 2, instead of through bores with plugs 14 therein, blind bores communicating with the chamber 15 may be provided. In that case it must be made sure, that individual bristles 4 cannot be pulled into these channels.

It is furthermore possible, that a configuration plate 10 is used which has no holes 11 matched to the arrangement of the bristle bundles 3. In order to enable configuring the bristles 4 of the individual bristle bundle in spite of that, it is sufficient, if the surface of the configuration plate 10 be laid out or configured to correspond with a base surfaces 12 of the blind holes 11. Finally it is also feasible to configure the bristles 4 of the individual bristle bundles 3 by a combination of compressed air and vacuum.

While a particular embodiment of the invention has been shown and described, various modifications thereof will be apparent to those skilled in the art, and it not intended that the invention be limited to the disclosed embodiment and/or details thereof, and departures may be made therefrom within the spirit and scope of the invention, as defined by the appended claims.

What is claimed is:

1. A method for configuring the use ends of bristles of at least one bristle bundle used for fabrication of bristle products, said method comprising the steps of:

providing a configuring device comprising a carrier having at least one channel for receiving the bristle bundle, and a configuration plate located adjacent to the carrier and including a configuration surface facing the at least one channel and having a configuration corresponding to a predetermined configuration of the used ends of bristles of the at least one bristle bundle;

cutting the at least one bristle bundle to a predetermined size;

inserting the at least one bristle bundle into the carrier channel; and applying gas pressure to ends of bristles of the at least one bristle bundle, which are opposite to the use ends, to bring the use ends in contact with the configuration surface, whereby the use ends are configured to the predetermined shape.

2. A method as set forth in claim 1, wherein said providing step includes providing a configuration device further comprising a pressure chamber communicating with the opposite ends of bristles of the at least one bristle bundle, and said applying step includes supplying compressed gas into the pressure chamber.

3. A method as set forth in claim 2, wherein said applying step includes supplying compressed gas having pressure of about 2–6 bars.

4. A method as set forth in claim 3, wherein the compressed gas is compressed air.

5. A method as set forth in claim 1, wherein said applying step includes applying vacuum to the use ends of bristles of the at least one bristle bundle, whereby the use ends are brought into contact with the configuration surface under action of atmospheric pressure.

6. A method as set forth in claim 5, wherein said providing step includes providing a configuring device comprising a configuration plate having a blind bore, the base surface of which forms the configuration surface, and a chamber in communication with the blind bore, and wherein said applying step includes creating vacuum in the configuration plate chamber.

7. A method as set forth in claim 5, wherein said providing step includes providing a configuring device comprising a configuration plate having a through bore, a porous plug located in the bore and having a surface defining the configuration surface, and a chamber in communication with the bore and wherein said applying step includes creating a vacuum in the configuration plate chamber.

* * * * *